United States Patent [19]

Sandmeier et al.

[11] 4,088,559

[45] May 9, 1978

[54] HOLDING DEVICE FOR SMALL PARTS TO BE ELECTROPLATED

[75] Inventors: Willi Sandmeier, Luterbach; Willi Uebelhart, Bellach, both of Switzerland

[73] Assignee: Sulzer Brothers Ltd., Winterthur, Switzerland

[21] Appl. No.: 740,654

[22] Filed: Nov. 10, 1976

[30] Foreign Application Priority Data

Nov. 11, 1975 Switzerland ..... 548/75

[51] Int. Cl.[2] ..... C25D 17/08

[52] U.S. Cl. ..... 204/297 W

[58] Field of Search ..... 204/297 R, 297 W, 297 M

[56] References Cited

U.S. PATENT DOCUMENTS

| | | | |
|---|---|---|---|
| 2,511,128 | 6/1950 | Russell | 204/297 W |
| 2,852,463 | 9/1958 | Gutzmer | 204/242 |
| 3,039,951 | 6/1962 | Clenard et al. | 204/297 W |
| 3,553,096 | 1/1971 | Coir | 204/297 W |
| 3,677,929 | 7/1972 | Young, Jr. | 204/286 |
| 3,701,726 | 10/1972 | Laboue | 204/297 R |

FOREIGN PATENT DOCUMENTS

| | | |
|---|---|---|
| 274,535 | 7/1951 | Switzerland. |

*Primary Examiner*—F.C. Edmundson

*Attorney, Agent, or Firm*—Kenyon & Kenyon, Reilly, Carr & Chapin

[57] ABSTRACT

The holding device is formed of an elongated bar with slots to receive a base of the parts to be electroplated and contact strips in the slots to electrically contact the received parts. Resilient electrical contact-making elements are disposed in facing relation to the contact strips to clamp the parts in place and to provide an additional electrical contact. The device also includes a plastic cover over the contact bar and resilient elements to protect the bar and elements. The bar is also provided with a hook at one end for securement to a frame for electroplating.

8 Claims, 6 Drawing Figures

HOLDING DEVICE FOR SMALL PARTS TO BE ELECTROPLATED

This invention relates to a holding device for small parts to be electroplated.

Heretofore, it has been known to electroplate small parts, particularly guide teeth for a shuttle feeding mechanism of a weaving machine, by placing the parts in a holding device and then subjecting the parts to an electroplating operation, e.g. to coat the parts with chromium. In such cases, the holding device has been constructed to function as a component of the electroplating circuit, i.e. as a cathode. In one such case, the holding device has been constructed of a contact bar which is encased in a casing of electrically insulating material with the parts to be treated being individually inserted into a recess in the casing and pressed against the contact bar by a pressure screw which penetrates the casing. However, such a construction requires a relatively large labor and checking effort in order to place the parts to be treated in the holding device as well as to remove the treated parts, as each screw must be tightened individually, checked for tightness and loosened again after treatment.

Accordingly, it is an object of the invention to provide a holding device which can be operated in the simplest possible manner.

It is another object of the invention to reduce the time and effort required to mount parts to be electroplated and remove the parts after electroplating without degrading the quality in the electroplating treatment.

Briefly, the invention provides a holding device for holding small parts to be electroplated. The holding device comprises a contact bar adapted to be connected to a current source as a cathode, and a plurality of holding means for connecting the parts to be electroplated to the contact bar. Each of these holding means includes a resilient contact-making element of electrically conductive material which is disposed on the bar in electrical conductive relation to resiliently clamp a respective part between the element and the contact bar. Each element is also shaped to permit insertion and removal of a respective part between the element and the contact bar.

The construction of the holding device facilitates handling and permits a considerable savings in time to be obtained in the operations preceding and following an electroplating treatment. This is because the three operations previously required namely, screwing in the parts to be treated, checking and loosening the screw connection, are eliminated. Further savings are also obtained due to the elimination of the corresponding screws which have been previously required and which because of their exposure to the treatment baths must be replaced frequently.

In using the holding device, two sides of the parts to be treated are always connected to the current source, i.e. via the contact bar as well as via the contact-making element. This ensures a flow of sufficient current even if contact-making elements with relatively little contact pressure are used. In this latter case, advantageously, little force is required to load the holding device manually.

In an embodiment which is particularly advantageous for mechanical loading, the contact bar may be provided with transverse slots disposed along a longitudinal axis of the bar for receiving the parts to be treated.

In order to improve the current flow or to assure a current flow under any operating condition, an electrically conducting contact portion may be provided in the contact bar for each of the parts to be treated. In this case, the contact portions project from the surrounding area of the bar and each forms a defined contact surface for the respective part. In one particularly advantageous embodiment with easily replaceable parts, the contact portion may be formed as a separate piece which can be removably mounted on the contact bar. In this connection, the contact area of the contact portion is preferably smaller than the surface of the part to be treated. Thus, a correspondingly larger contact pressure and thus, a further improvement of the current flow between the parts to be treated and the contact bar can be achieved.

In a further embodiment which is particularly practical due to the use of replaceable parts and which is particularly reliable in operation, use is made of clamping strips of electrically conducting material which are fastened to the contact bar in an electrically conducting manner and which extend over at least two of the contact-making elements to clamp against these elements.

In another embodiment, which is particularly advantageous and requires little maintenance, the contact-making element may be a leaf spring which can be clamped at one end to the contact bar.

These and other objects and advantages of the invention will become more apparent from the following detailed description and appended claims taken in conjunction with the accompanying drawings in which:

Figure 1:
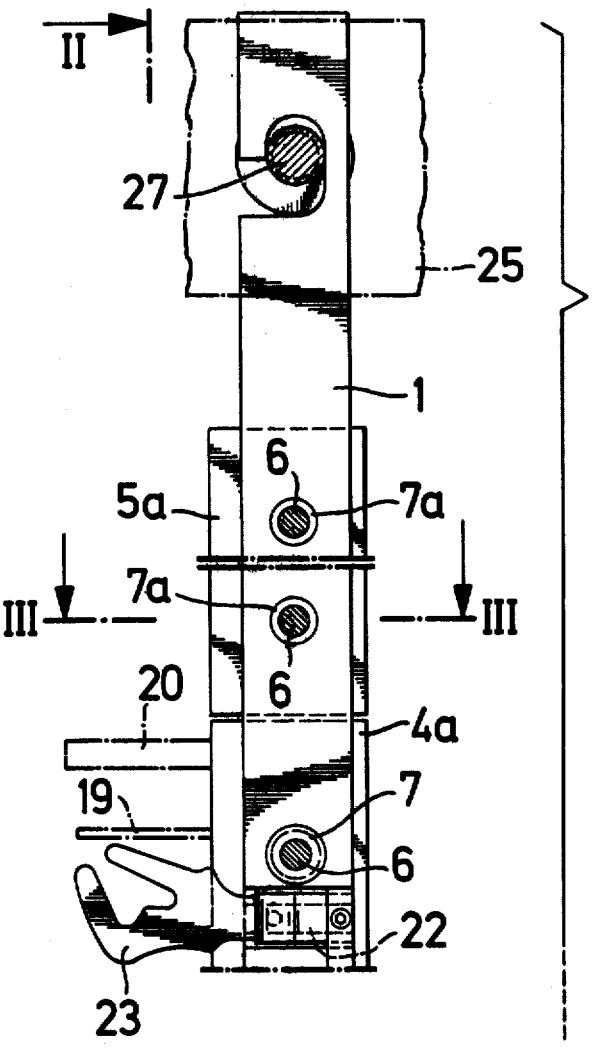
FIG. 1 illustrates a cross-sectional view corresponding to the line I—I in FIG. 2 of a holding device according to the invention.
Figure 1:
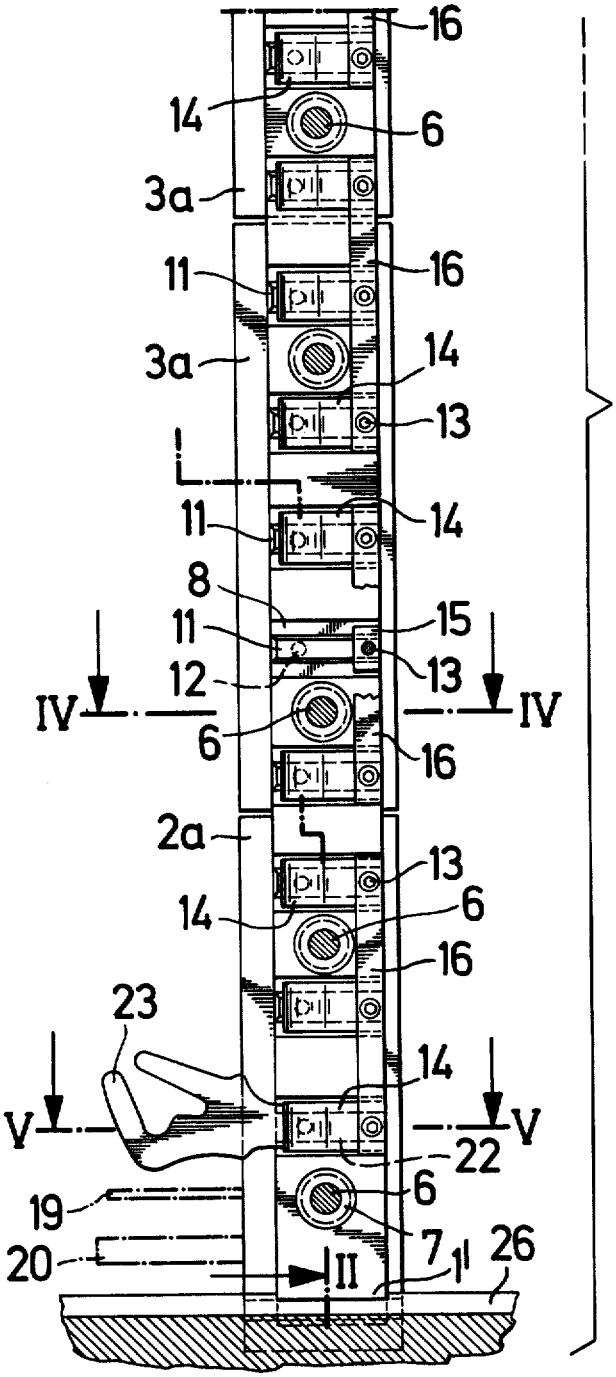
Figure 2:
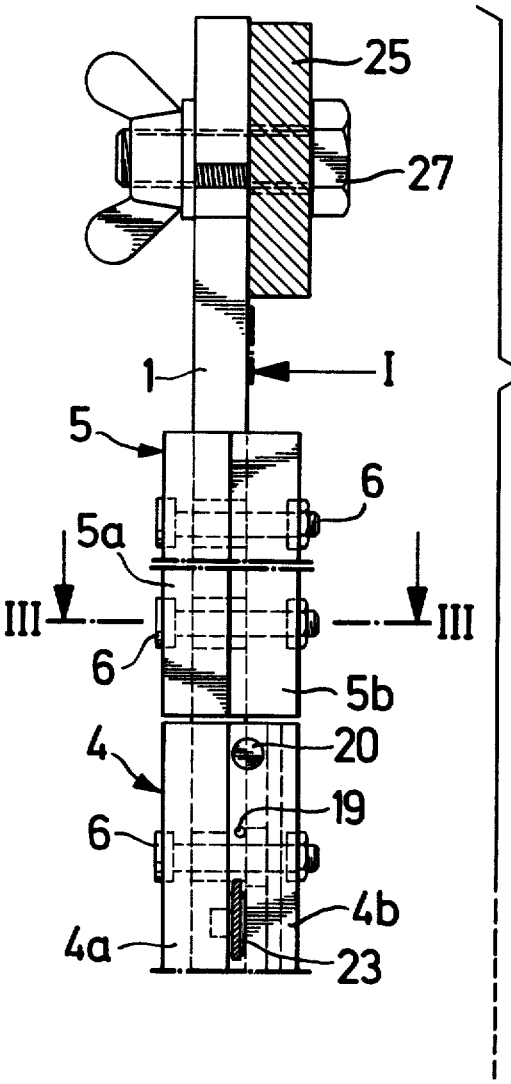
FIG. 2 illustrates a side view of the holding device partly in cross section and corresponding to the line II—II of FIG. 1.
Figure 2:
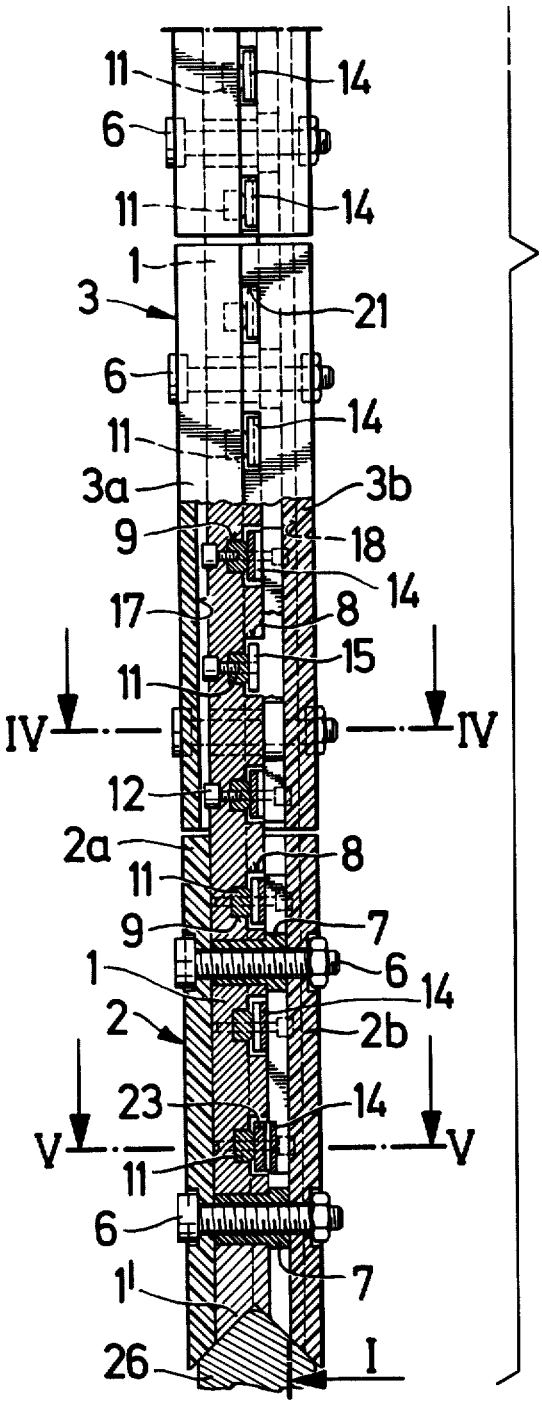
Figure 3:
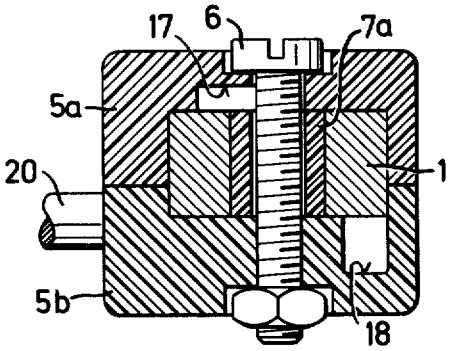
FIG. 3 illustrates a view taken on line III—III of FIG. 1.

Referring to FIGS. 1 and 2, the holding device includes an elongated contact bar 1 which is encased in a cover 2, 3, 4, 5 of non-conducting material. As shown, the cover 2–5 surrounds the bar 1 over the major part of the bar length and is formed by pairs of oppositely facing channel-shaped elements *2a*, *2b*; *3a*, *3b*; *4a*, *4b*; *5a*, *5b*. These cover elements are made of Teflon and are spaced apart longitudinally of the contact bar 1. Each pair of cover elements is secured to the contact bar 1 by a pair of screws 6. The screws 6 are passed through sleeves 7 and *7a*, respectively, which are arranged in the contact bar 1 and likewise consist of Teflon.

Figure 4:
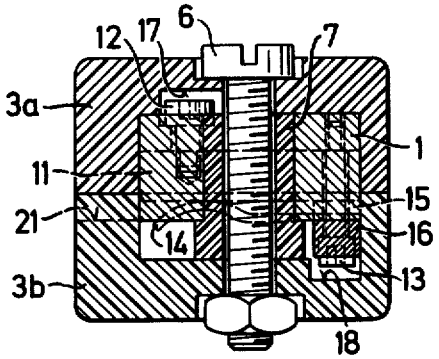
FIG. 4 illustrates a view taken on line IV—IV of FIG. 1.

One side of the contact bar 1 is provided with mutually parallel transverse slots 8 which are disposed along the longitudinal axis of the bar 1 and are each continued in a further slot 9. In addition, a contact strip 11 is placed in each slot 9 to project beyond the bottom of the slot 8 and, as such, to form a contact surface 11'. Each strip 11 is removably secured via screws 12, 13 to the contact bar 1 (FIG. 4). The heads of the screws 12, 13 are partially countersunk in the contact bar 1 and in clamping strips 16 respectively which each extend over three slots 8. The screws 13 are each passed through a contact-making element formed by a leaf spring 14 and a stop element 15 which is inserted into the slot 8 and rests against the contact strip 11. The contact bar 1 and the parts 11 to 16 are therefore connected in an electrically conducting manner.

Each leaf spring 14 protrudes with an end 14' bent in spoon-fashion into a respective slot 8 and is pressed against the respective contact area 11' under tension.

Figure 5:
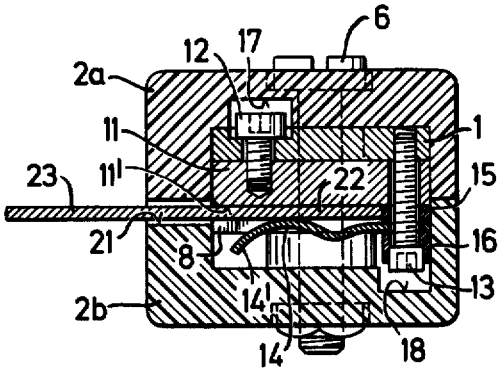
FIG. 5 illustrates a view taken on line V—V of FIG. 1.
Figure 6:
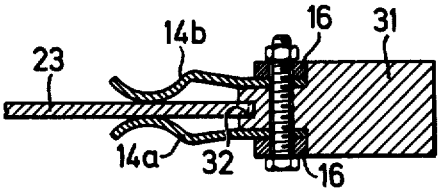
FIG. 6 illustrates a cross-sectional view of a modified holding device according to the invention.

Referring to FIGS. 4 and 5, the heads of the screws 12, 13 project into longitudinal slots 17 and 18, respectively, which are provided in the covers 2, 3, 4 and 5. The cover elements **2*b*, 3*b* and 4*b* each have a profile which surrounds the contact bar 1 with a spacing which allows spring movement of the single-ended, clamped leaf springs 14. Also, each cover element 2*b*, 3*b*, 4*b* is provided with recesses 21 through each of which a holding portion or base 22 of a work piece 23 to be treated by electroplating can be inserted. As shown, the work piece 23 is a guided tooth for a shuttle of a weaving machine and has guide prongs which are to be plated with chromium (FIG. 1**).

As shown in FIG. 2, the contact bar 1 is provided with a triangular shaped profile at the lower end 1' and, as shown in FIG. 1, is hook-shaped at the opposite end.

Referring to FIG. 1, a limiting pin 19 and a spacer pin 20 are attached to the cover elements **2*b*, 4*b* at a small distance ahead of the first and behind the last recess 21 and in line with the work pieces 23** to be treated.

The holding device is loaded manually with guide teeth 23 by inserting the holding portion (base) 22 of each through one of the recesses 21 between the contact strip 11 and the associated leaf spring 14 and by pushing the tooth 23 against the stop element 15. The holding portion 22 is thus pressed against a contact surface 11' of a strip 11 by the end 14' of a leaf spring 14. Due to the bent spring end 14' which practically makes line contact, on the one hand, and with the contact area 11' made appropriately small, on the other hand, the guide tooth 23 is held during the subsequent treatment under relatively high contact pressure. This also ensures sufficient current flow between the interacting parts.

In FIGS. 1 and 2, the holding device is shown in a vertical operating position in which the device is clamped together with other holding devices in a vertical electroplating treatment frame (not shown) only two frame rods 25, 26 of which are shown. These rods 25, 26 are horizontal in the operating position. The contact bars 1 completely loaded with guide teeth 23 are placed individually with their suitably profiled lower ends 1' on the lower frame rod 26 and are fastened at the hook-shaped upper ends (FIG. 1) to the upper frame rod 25 by means of a screw 27 so as to form an electrical connection with the treatment frame. The distance between holding devices adjacent in the frame is established by the spacer pins 20 which project somewhat beyond the parts 23 to be treated.

The treatment frame can be connected as a cathode to a current source in a manner known per se and is immersed, with the holding devices inserted into electroplating baths (not shown) which contain the anode of the current source in a likewise known manner. In hard chrome-plating the guide teeth 23, the treatment frame loaded with the holding devices is taken through three electrolytic baths, for degreasing, etching and chromium-plating, and subsequently through a rinsing bath and a drying oven. In this process, the guide teeth 23 are partially chromium-plated in the desired manner, as the coating material then precipitates only on the areas which protrude from the recesses 21 of the covers 2, 3, 4.

The covers 2, 3, 4, 5 can be made simply and inexpensively, as they have no passage openings which must be arranged with particular accuracy, such as, for instance, for holding means of the parts to be treated. Furthermore, the covers 2, 3, 4, 5 are not stressed by the contact forces or their corresponding reaction forces of the holding device.

The limiting pins 19 allow a coating of uniform thickness to be electroplated on the two outermost guide teeth 23 of each holding device as the drop-like enlargements otherwise formed at the outermost part cannot settle on the teeth.

Various other embodiments of the invention are also possible.

Instead of leaf springs, any other resilient contact-making elements can be used, for instance, pins loaded by coil springs or the like. The contact-making elements can also be connected to the contact bar individually without a common clamping strip. Furthermore, other means of connection, e.g. rivets or a soldered joint, can also be used. Also, the cover may consist of a single piece or several sleeve-like single-part pieces. It is understood that instead of Teflon, another material resistant to the respective treatment baths, such as, for instance, nylon or the like may be chosen.

Depending on the shape of the parts to be treated, the slots provided to guide the parts may be arranged at an angle to the longitudinal axis of the contact bar. Constructions with differently shaped guiding recesses, e.g. appropriate drill holes, are also possible. Similarly, constructions without guiding recesses for guiding the parts to be treated are also conceivable. In lieu of the contact strips described, differently shaped contact elements can be used, e.g. plates with circular contact surfaces for the parts to be treated. Instead of separate contact elements, appropriate strip-shaped or ridge-like projections can be formed on the contact bar itself.

What is claimed is:

1. A holding device for holding small parts to be electroplated, said holding device comprising a contact bar adapted to be connected to a current source as a cathode;

a plurality of contact strips disposed along said bar with each contact strip in projecting relation to the surrounding area of said bar to form a defined contact surface, and a plurality of holding means for connecting the parts to be electroplated to said contact bar, each said holding means including a resilient contact-making leaf-spring element of electrically conductive material disposed in facing relation to a respective contact strip and on said bar in electrical conductive relation to resiliently clamp a respective part between said element and a respective one of said contact strips, each said element being shaped to permit insertion and removal of a respective part between said element and said respective contact strip.

2. A holding device as set forth in claim 1 wherein said contact bar has a plurality of transverse slots disposed along a longitudinal axis of said bar for receiving the respective parts therein with each contact strip disposed transversely within a respective one of said slots.

3. A holding device as set forth in claim 1 wherein said contact strips are removably mounted on said bar.

4. A holding device as set forth in claim 3 which further comprises a plurality of clamping strips, each said clamping strip being removably secured to said contact bar to extend over at least two of said contact-making elements to clamp said elements in said bar.

5. A holding device for holding parts to be electroplated comprising an elongated contact bar having a plurality of longitudinally spaced apart slots for receiving parts to be electroplated and a plurality of electrical contact strips, each said strip being disposed within a respective slot in projecting relation to the surrounding area of said bar to define a contact surface; and a plurality of resilient contact-making elements of electrically conductive material disposed on said bar in electrically conductive relation and in facing relation to said contact strips to resiliently clamp a respective part between each element and facing contact strip.

6. A holding device as set forth in claim 5 which further includes means removably securing each of said contact strips to said contact bar, said means including a plurality of threaded screws, each said screw passing through a respective contact-making element and a respective contact strip.

7. A holding device as set forth in claim 6 which further comprises a plurality of clamping strips, each said clamping strip being removably secured to said contact bar to extend over at least two of said contact-making elements to clamp said elements to said bar with two at said screws passing through each said clamping strip.

8. A holding device as set forth in claim 5 which further comprises a cover of non-conducting material encasing said contact bar, said cover including pairs of oppositely facing channel shaped elements, said cover elements defining recesses therebetween, each said recess being aligned with a respective slot in said contact bar to permit insertion of a part to be electroplated.

* * * * *